United States Patent [19]

Riddick, Jr. et al.

[11] 4,213,850

[45] Jul. 22, 1980

[54] HYDRODESULFURIZATION OF OIL FEEDSTOCK WITH PRESULFIDED CATALYST

[75] Inventors: Frank C. Riddick, Jr., Orange; Bernal Peralta, Santa Ana, both of Calif.

[73] Assignee: Union Oil Company of California, Los Angeles, Calif.

[21] Appl. No.: 920,450

[22] Filed: Jun. 29, 1978

Related U.S. Application Data

[63] Continuation-in-part of Ser. No. 800,792, May 26, 1977, abandoned.

[51] Int. Cl.[2] ..... C10G 23/02

[52] U.S. Cl. ..... 208/216 R; 252/439

[58] Field of Search ..... 208/216 R, 211, 143, 208/213; 252/439

[56] References Cited

U.S. PATENT DOCUMENTS

| | | | |
|---|---|---|---|
| 2,758,957 | 8/1956 | Nozaki | 208/143 |
| 2,761,816 | 9/1956 | Sweetser et al. | 208/216 |
| 3,000,816 | 9/1961 | Vernon et al. | 208/216 |
| 3,140,994 | 7/1964 | Derr, Jr. et al. | 208/216 |
| 3,269,938 | 8/1966 | Lefrancois | 208/216 |
| 3,423,307 | 1/1969 | McKinney et al. | 208/213 |
| 3,441,500 | 4/1969 | Wunderlich | 252/439 |
| 3,933,683 | 1/1976 | Hilfman | 252/439 |
| 3,948,763 | 4/1976 | Christman et al. | 208/216 |

FOREIGN PATENT DOCUMENTS

| | | | |
|---|---|---|---|
| 1324034 | 7/1973 | United Kingdom | 252/439 |

*Primary Examiner*—George J. Crasanakis
*Attorney, Agent, or Firm*—Lannas S. Henderson; Gregory F. Wirzbicki; Dean Sandford

[57] ABSTRACT

Hydrofining catalysts comprising cobalt and/or nickel oxides plus molybdenum and/or tungsten oxides are presulfided with mixed sulfiding agents comprising (1) a liquid phase heavy mineral oil fraction containing native organic sulfur and (2) a gaseous mixture of hydrogen and $H_2S$, the contacting being carried out at temperatures sufficiently high to convert some but not more than about 90% of the organic sulfur in the mineral oil fraction to $H_2S$.

6 Claims, 2 Drawing Figures

HYDRODESULFURIZATION OF OIL FEEDSTOCK WITH PRESULFIDED CATALYST

RELATED APPLICATIONS

This application is a continuation-in-part of Ser. No. 800,792, filed May 26, 1977 and now abandoned.

BACKGROUND AND SUMMARY OF INVENTION

The art is replete with methods for presulfiding hydrofining catalysts which contain cobalt oxide and/or nickel oxide plus molybdenum oxide and/or tungsten oxide. The overall objective is to temper the "wild" initial activity of the oxide-form catalyst, thereby reducing the deactivation rate of the catalyst, and usually improving its activity for desulfurization and denitrogenation.

Perhaps the most widely used procedure involves contacting the catalyst with a gaseous mixture of hydrogen and $H^2S$ at elevated temperatures. The presence of hydrogen appears to give a more active catalyst, apparently by maintaining the Group VIB metal sulfide component in an optimum valence state. However, the use of hydrogen in such processes presents certain problems. At elevated temperatures, above about 500° F. (which are normally required to complete the sulfiding) hydrogen in the absence of $H_2S$ tends to reduce some of the active metal oxides to free metals, resulting in agglomeration, particularly with respect to molybdenum. When a mixed gas stream of $H_2$-$H_2S$ is passed through a deep bed of catalyst, all of the $H_2S$ is initially chemisorbed or combined with the upper layers of the catalyst bed, leaving the lower portion of the bed substantially free of $H_2S$. It is therefore necessary to first sulfide the entire bed of catalyst at relatively low temperatures, and then gradually raise temperatures to complete the sulfiding. Another difficulty with gas phase presulfiding is that the reaction is exothermic, and depending on metals concentration, can generate very high instantaneous temperatures at the active sites, resulting in a lowering of activity.

It is known in the art that the foregoing difficulties can be substantially alleviated by presulfiding with hydrogen and a hydrocarbon feedstock containing native organic sulfur compounds and/or added organic sulfur compounds such as mercaptans, thioethers, carbon disulfide, thiophene and the like. By contacting such sulfur-containing feedstocks with the catalyst under mile conditions, such that the conversion of organic sulfur compounds to $H_2S$ is incomplete, the generation of $H_2S$ will take place throughout all parts of the catalyst bed, thereby preventing reduction of the active metal oxides. Also, the presence of unreacting hydrocarbons provides a heat sink, thereby preventing local overheating.

The present invention represents an improvement over all the foregoing methods. We have discovered that a catalyst of improved stability and activity is produced when the catalyst is sulfided using mixed sulfiding agents comprising (1) a heavy liquid phase mineral oil fraction containing at least about 0.5 wt.% of native organic sulfur, and (2) a gaseous $H_2$-$H_2S$ mixture containing about 0.3%–10% by volume of $H_2S$. Catalysts sulfided with these mixtures are found to display an initially quite rapid deactivation rate which, most unexpectedly, levels out to a very low rate after a few days on stream. While we are unable to account with any degree of certainty for this surprising result, it is possible that it may be related to the temperature profile prevailing in the catalyst bed during presulfiding.

In an adiabatic reactor containing a substantial bed depth of catalyst, the temperature profiles generated during presulfiding can be fairly complex. Hydrogen sulfide itself generates an exotherm which travels slowly down the catalyst bed as sulfiding progresses. Sulfiding with $H_2S$ generated by the decomposition of organic sulfur compounds native to mineral oil feedstocks tends to generate a gradually ascending temperature profile downwardly through the reactor. Sulfiding via the decomposition of easily decomposable added organic sulfur compounds such as mercaptans generates two types of exotherms: the first remains relatively stationary near the top of the catalyst bed and is attributable to the hydrocracking of the sulfur compound to form $H_2S$; the second is attributable to the generated $H_2S$ combining with the catalytic metals, and moves gradually downward in the reactor as the catalyst becomes sulfided. The process of this invention provides a combination of a gradually ascending temperature profile due to desulfurization of feedstock, and a downwardly travelling exotherm due to the added $H_2S$, with no stationary exotherm. It is conceivable that this represents an optimum temperature profile for presulfiding.

It should be noted that in some prior art processes for presulfiding with hydrocarbon feedstocks, the effluent gas phase is continuously recycled. If this gas phase contained $H_2S$, it would appear that the benefits of the present invention would automatically be obtained. However, some prior art disclosures (e.g. U.S. Pat. No. 3,948,763) suggest removing such $H_2S$ from the recycle gas, and in any event very little $H_2S$, i.e., less than about 20 ppm, would normally be present in such gases while the catalyst is still being actively sulfided. Maximum benefits of the present invention are not obtained unless $H_2S$ is present in the influent gases substantially before the catalyst is completely sulfided, as evidenced by the presence of substantially the same amount of total sulfur in the effluent from the catalyst bed as is being fed thereto under sulfiding conditions. We do not exclude however the obtaining of some substantial benefits of the invention by initiating the presulfiding with feedstock alone (and hydrogen) and adding $H_2S$ to the influent gases at some later time, but before completion of the sulfiding.

Data submitted hereinafter will show that the claimed presulfiding method is superior to:

(1) presulfiding with gaseous $H_2$-$H_2S$ mixtures;

(2) presulfiding with feedstock alone; and (3) presulfiding with the feedstock plus an added mercaptan.

DETAILED DESCRIPTION

Figure 1:
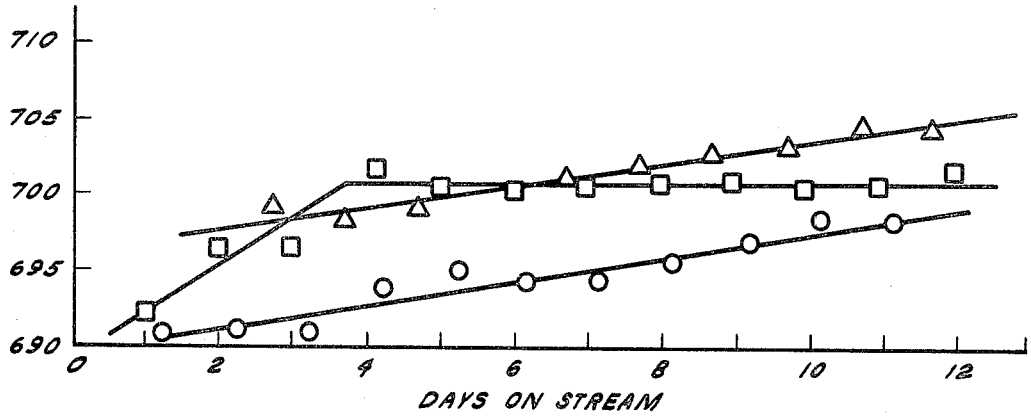
FIG. 1 is a graph depicting some of the data hereinafter presented in Examples 5–8.

Catalysts contemplated for treatment herein fall within the following composition ranges:

| Catalyst Composition, Wt. % | | |
|---|---|---|
| Component | Broad Range | Preferred Range |
| CoO and/or NiO | 2–20 | 3–10 |
| $MoO_3$ and/or $WO_3$ | 5–35 | 8–25 |
| $SiO_2$ | 0–15 | 1–5 |
| $Al_2O_3$ | Balance | |
| Wt. Ratio, (CoO + NiO)/($MoO_3$ + $WO_3$) | 0.1–1 | 0.12–0.5 |

The preferred catalysts comprise molybdenum plus Co and/or Ni, and especially Co. Minor amounts of other known activators such as chlorine, fluorine or $P_2O_5$ may also be present. Such catalysts are well known in the art and hence need not be described in detail.

Presulfiding feedstocks for use herein may comprise any minearl oil distillate containing at least about 0.5 wt.%, and preferably at least about 1.0 wt.% of native organic sulfur, and having a 50% boiling point (ASTM) above about 600° F. Preferably, the 80% boiling point should be above about 750° F. Exemplary types of feedstocks include virgin vacuum gas oils, virgin atmospheric gas oils, heavy thermal cracker gas oils, catalytic cracking cycle oils and the like. The selection of heavy feedstocks such as these is believed to provide an optimum specturm of sulfur compounds of differing boiling points and refractoriness, whereby generation of $H_2S$ throughout the catalyst bed is more nearly equalized. Preferably the feedstock should contain less than about 10 wt.% of material boiling below 400° F., and no organic sulfur compounds boiling below about 400° F. should be added thereto.

The $H_2S$-$H_2$ mixtures utilized herein may comprise about 0.3–10%, preferably about 1–5 vol. % $H_2S$. Presulfiding conditions fall within the following ranges:

| Presulfiding Conditions | | |
|---|---|---|
| | Broad Range | Preferred Range |
| Temp. °F. | 450–700 | 500–650 |
| LHSV | 0.2–10 | 0.5–3 |
| Pressure, psig | 200–2000 | 400–1000 |
| $H_2$/oil Ratio, SCF/B | 300–5000 | 500–3000 |

For reasons previously discussed, the temperature should be correlated with space velocity so as to convert between about 20% and 90%, preferably about 25–80%, of the organic sulfur to $H_2S$. Preferably, the temperature is raised somewhat gradually to the above levels, and maintained until the total sulfur content of the reactor effluent is substantially the same as the total sulfur input to the reactor, indicating completion of sulfiding.

Both the added $H_2S$ and the presulfiding feed are preferably present at the start of the sulfiding operation, and still more preferably substantially throughout the presulfiding period, but as previously noted, some benefit of the invention is obtained when the addition of $H_2S$ is commenced at any time substantially before completion of the sulfiding, i.e., during the time while the catalyst is being actively sulfided, as evidenced by the presence of less total sulfur in the effluent from the catalyst bed than the total amount being fed thereto.

The sulfided catalysts may be utilized for the hydrofining of substantially any mineral oil feedstock, including naphthas, light and heavy virgin gas oils, coker distillates, catalytic cracking cycle oils, crude oils, residual oils, etc. Desulfurization and/or denitrogenation of such oils is carried out under the following general conditions:

| Hydrofining Conditions | | |
|---|---|---|
| | Broad Range | Preferred Range |
| Temp. °F. | 500–850 | 550–750 |
| LHSV | 0.2–10 | 0.5–3 |
| Pressure, psig | 300–3000 | 800–2000 |
| $H_2$/oil Ratio, SCF/B | 500–8000 | 800–5000 |

Where denitrogenation is the primary objective the preferred catalysts comprise nickel plus molybdenum and/or tungsten, while for desulfurization preferred catalysts comprise cobalt plus molybdenum and/or tungsten.

The following examples are illustrative of the invention:

EXAMPLES 1–4

Portions of a conventional fresh hydrofining catalyst comprising in weight-percent, 14.7 $MoO_3$, 4.8 CoO, 1.1 $SiO_2$, 0.27 $P_2O_5$, and the balance $Al_2O_3$ were subjected to four different presulfiding procedures, as follows:

Procedure A: A conventional gas-phase presulfiding, using a 10% $H_2S$–90% $H_2$ mixture at 500 GHSV, and at temperatures programmed from room temperature to 700° F. over a period of about 20 hours.

Procedure B: A "spiked" feed presulfiding, using a Kuwait heavy vacuum gas oil containing sufficient added butyl mercaptan to give a total sulfur content of 3.22 wt.%. After thoroughly wetting the catalyst with this mixture at 400° F. and 310 psig of hydrogen (to avoid subsequent channeling of the feed), the reactor pressure was increased to 600 psig with hydrogen. Presulfiding was then commenced at 1.0 LHSV and 1190 SCF/B of hydrogen (at this hydrogen rate, the added butyl mercaptan corresponds to about 3.3 mole-percent $H_2S$ in the hydrogen), with temperatures increasing to 600° F. at 100° F./Hr, and holding at 600° F. for 16 hours. At this point the total sulfur content of the effluent products was substantially the same as the total sulfur input, indicating complete sulfiding of the catalyst.

Procedure D: Same as procedure B except that no sulfur compound was added to the feed. (Original feed sulfur content, 2.2 wt.%).

Procedure E: Same as procedure D except that instead of pure hydrogen a mixture of 2% $H_2S$–98% $H_2$ was used.

EXAMPLES 5–8

Each of the foregoing sulfided catalysts was tested to determine desulfurization activities and deactivation rates over run periods of approximately 10 days. The feed employed was the same Kuwait vacuum gas oil used for presulfiding in procedures B, D and E, and analyzed as follows:

| Feed Properties | |
|---|---|
| Gravity, °API | 27.7 |
| Sulfur, wt.% | 2.2 |
| Nitrogen, wt.% | 0.053 |
| Boiling Range, °F. | |
| IBP | 395 |
| 20% | 622 |

-continued

| Feed Properties | |
|---|---|
| 50% | 740 |
| 80% | 856 |
| Max. | 987 |

Test conditions were: 300 psig, $H_2$/oil ratio 1500 SCF/B, LHSV 1.5. Temperatures were adjusted for a target 95% desulfurization; product samples were taken at 6-hour intervals, and 24-hour composites were subjected to analysis. From the analytical data, and using calculations based on 1.5 order kinetics, the observed temperatures required for the actual percent conversions of sulfur compounds were converted to the corresponding temperatures which would be required for exactly 95% conversion. (In all cases the actual conversions were 95±2%). The results were as follows:

TABLE I

| Composite Sample | Temp. Required for 95% Desulfurization, °F. Presulfiding Method A | B | D | E |
|---|---|---|---|---|
| 1 | 697.9 | 691.2 | — | 691.6 |
| 2 | — | 690.9 | — | 696.5 |
| 3 | 700.5 | 691.1 | 698.8 | 696.3 |
| 4 | — | 694.2 | 697.9 | 702.1 |
| 5 | 702.1 | 695.1 | 698.9 | 700.5 |
| 6 | 702.7 | 694.5 | — | 700.3 |
| 7 | 703.1 | 694.0 | 701.6 | 700.5 |
| 8 | 704.7 | 695.4 | 702.3 | 701.1 |
| 9 | 705.1 | 696.9 | 702.6 | 701.3 |
| 10 | 705.1 | 698.4 | 703.1 | 700.4 |
| 11 | — | 698.1 | 704.6 | 700.6 |
| 12 | — | — | 704.1 | 702.2 |

The foregoing data for presulfiding methods B, D and E are plotted in FIG. 1, and it is apparent that method E gave very surprising results. The catalyst sulfided by this method deactivated quite rapidly for the first 4 days, but for the next 8 days its deactivation rate was substantially nil. Although at the end of 11 days the catalyst from method B was still slightly more active than the method E catalyst, it is apparent that its rate of deactivation would very soon lead to an inferior activity, as the succeeding examples will bear out. Method A obviously gives a result inferior to each of methods B, D or E.

EXAMPLES 9-11

At the end of the foregoing runs, the catalysts presulfided by methods B, D and E were tested further for the desulfurization of a more difficult feedstock, an Arabian vacuum gas oil having the following properties:

| Feed Properties | |
|---|---|
| Gravity, °API | 22.3 |
| Sulfur, wt.% | 2.37 |
| Nitrogen, wt.% | 0.079 |
| Boiling Range, °F. | |
| IBP | 693 |
| 20% | 777 |
| 50% | 850 |
| 80% | 920 |
| MaX. | 1053 |

Under the same test conditions, the results were as follows:

TABLE 2

| Composite Sample | Temp. Required for 95% Desulfurization, °F. Presulfiding Method B | D | E |
|---|---|---|---|
| 12 | 734.4 | — | — |
| 13 | 739.2 | 743.4 | 737.4 |
| 14 | 742.3 | 747.6 | 741.7 |
| 15 | 746.8 | 751.2 | 744.0 |
| 16 | 750.7 | 755.4 | 746.7 |
| 17 | 754.6 | 759.4 | 749.4 |
| 18 | 756.8 | 762.1 | 750.1 |
| 19 | 750.3 | — | 753.2 |
| 20 | 763.9 | 769.3 | 754.8 |
| 21 | 765.7 | 773.9 | 758.1 |

Figure 2:
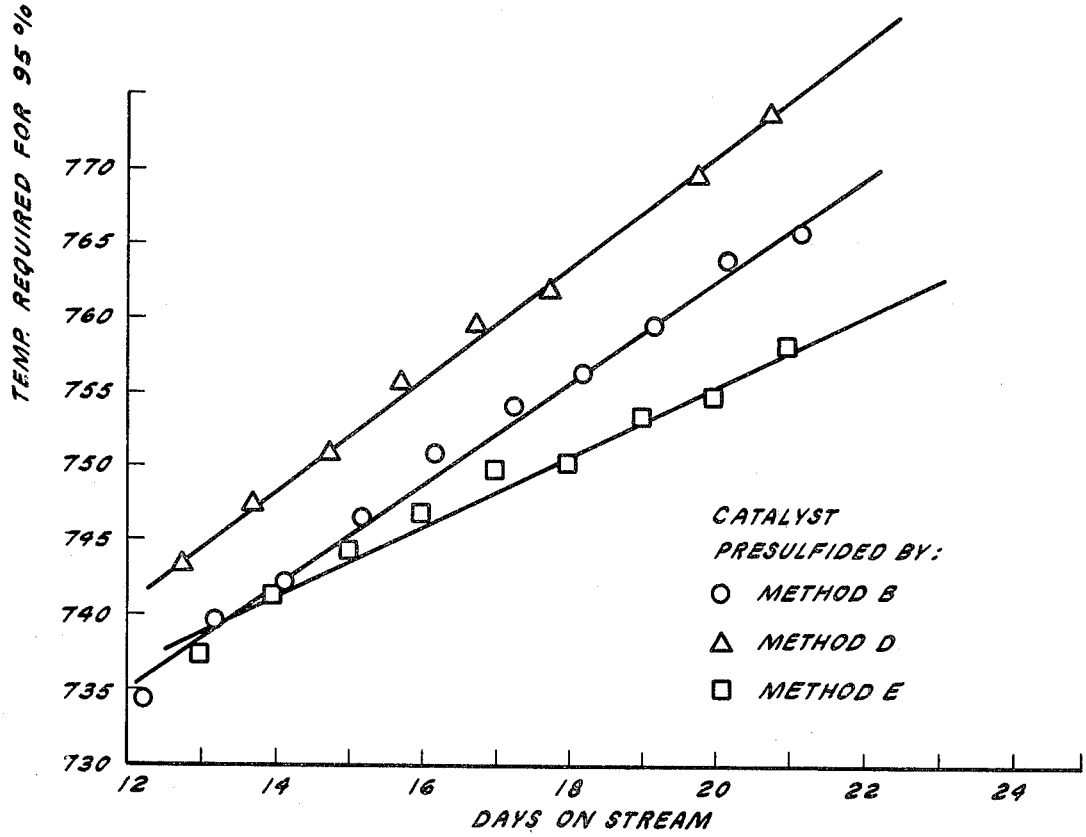
FIG. 2 is a graph depicting the data hereinafter presented in Examples 9–11.

The foregoing data are plotted in FIG 2, and it is apparent that after about 14 days on stream, the catalyst of method E became more active, and was deactivating at a definitely lower rate, than either of the other catalysts.

The following claims and their obvious equivalents are believed to define the true scope of the invention.

We claim:

1. A process for the desulfurization of a mineral oil feedstock containing organic sulfur compounds, which comprises contacting said feedstock plus added hydrogen, and under hydrofining conditions with a sulfided bed of catalyst comprising cobalt and/or nickel plus molybdenum and/or tungsten supported on a porous carrier which is essentially alumina, said catalyst bed having been converted from its initial oxide form to said sulfided form by a method which comprises passing a fluid sulfiding stream through said catalyst bed, said sulfiding stream comprising at the inlet to said catalyst bed (1) a gas stream comprising hydrogen, (2) sufficient free $H_2S$ to provide an $H_2S$ concentration in said gas stream of between about 0.3 and 10.0 vol % and (3) a liquid mineral oil fraction having a 50% boiling point above about 600° F. and containing at least about 0.5 wt.% of native organic sulfur, maintaining contacting temperatures in said bed above about 450° F. but not high enough to convert more than about 90% of said organic sulfur to $H_2S$ whereby some $H_2S$ is continuously generated throughout said bed, and while resultant sulfiding of said catalyst bed proceeds toward completion, withdrawing therefrom a total fluid effluent containing less total sulfur than the amount being fed thereto in said sulfiding stream.

2. A process as defined in claim 1 wherein said catalyst subjected to said sulfiding comprises CoO and $MoO_3$.

3. A process as defined in claim 1 wherein said mineral oil fraction is a heavy gas oil having an 80% boiling point above about 750° F.

4. A process as defined in claim 1 wherein at least about 50% of said mineral oil fraction remains in the liquid phase during passage through said catalyst bed.

5. A process as defined in claim 1 wherein said contacting temperatures are between about 500° and 650° F. and are correlated with space velocity so as to convert between about 25% and 80% of said native organic sulfur to $H_2S$.

6. A process as defined in claim 1 wherein said sulfiding stream is passed through said catalyst bed under the specified conditions until a total fluid effluent therefrom is obtained which contains substantially the same amount of total sulfur as is being fed thereto in said sulfiding stream.

* * * * *